United States Patent [19]

Schlecht

[11] 4,382,752

[45] May 10, 1983

[54] TWIN-CYLINDER PUMP, IN PARTICULAR FOR PUMPING THICK LIQUIDS

[76] Inventor: Karl Schlecht, Hainbuchenweg 47, D-7000 Stuttgart 70, Fed. Rep. of Germany

[21] Appl. No.: 209,465

[22] PCT Filed: Jan. 31, 1980

[86] PCT No.: PCT/DE80/00011

§ 371 Date: Oct. 1, 1980

§ 102(e) Date: Sep. 25, 1980

[87] PCT Pub. No.: WO80/01594

PCT Pub. Date: Aug. 7, 1980

[30] Foreign Application Priority Data

Feb. 1, 1979 [DE] Fed. Rep. of Germany ..... 2903749

[51] Int. Cl.[3] ..... F04B 15/02

[52] U.S. Cl. ..... 417/516; 417/519; 427/532; 427/900

[58] Field of Search ..... 417/515, 516, 517, 519, 417/532, 900

[56] References Cited

U.S. PATENT DOCUMENTS

| | | | |
|---|---|---|---|
| 3,929,400 | 12/1975 | Merton et al. | 417/516 |
| 3,989,420 | 11/1976 | Taylor | 417/517 |
| 4,106,882 | 8/1978 | Sherrod | 417/517 |
| 4,178,142 | 12/1979 | Schwing | 417/516 |

FOREIGN PATENT DOCUMENTS

| | | | |
|---|---|---|---|
| 2835590 | 4/1979 | Fed. Rep. of Germany | 417/516 |
| 55-78182 | 6/1980 | Japan | 417/516 |

*Primary Examiner*—Richard E. Gluck
*Assistant Examiner*—Peter M. Cuomo
*Attorney, Agent, or Firm*—Toren, McGeady and Stanger

[57] ABSTRACT

In pumps for viscous substances, particularly pumps for concrete, with two feed cylinders (2) opening out into a hopper (1), which cylinders (2) alternately draw the material to be forwarded from the hopper (1) and press it via a swingable S-shaped tube (5), arranged within the hopper (1), into a delivery pipe, the swivel bearing is constructed in such a way that the pressure of the material to be forwarded is changed into an axial thrust force on the axially movably arranged swivel tube (5) whereby the contact pressure of a wear ring (20) is increased, to ensure a sealing abutment of the wear ring attached to the end of the swivel tube with the rear wall (44) of the hopper (1) including the outlets of the feed cylinders, which wall (44) may if necessary, be reinforced with a spacer (22), and to ensure uniform wear over the whole face of the wear ring (20). Uniform wear of the wear ring (20) over the whole of its face is additionally effected in that the wear ring (20) is rotatably mounted on the end of the swivel tube (5).

12 Claims, 3 Drawing Figures

TWIN-CYLINDER PUMP, IN PARTICULAR FOR PUMPING THICK LIQUIDS

FIELD OF TECHNOLOGY

The invention relates to a pump with two cylinders, arranged parallel to each other and opening into a hopper, particularly for the delivery of viscous substances such as, for example, concrete. A S-shaped swivel tube is arranged within the hopper, swingingly mounted in the hopper with its end facing the feed cylinders swiveling alternately in line with one and then the other feed cylinders and tube sealingly abuts the rear wall of the hopper by means of a wear ring.

In pumps of this type, the material to be forwarded is drawn into one feed cylinder from the hopper during the return stroke of the piston in this cylinder, while with the simultaneous forward stroke of the piston in the other feed cylinder, the material to be forwarded, drawn into this cylinder beforehand, is pressed through the swivel tube into the delivery line connected to the tube.

In the construction of these pumps care must be taken that the wear ring, during each compression stroke of one of the feed cylinders, is closely adjacent the rear wall of the hopper or a spacer consisting of wear-resistant material covering the rear wall, to prevent liquid and also finely grained components of the material to be forwarded from issuing from this material at this location such issuance leads to increased wear of the parts moving against one another and, in the case of concrete, causes the concrete to weaken. It has been determined, during the very high pressure action, by which, for example, concrete is pressed through the swivel tube, that this tube is lifted from the rear wall of the hopper or from the spacer attached to this rear wall and is also subject to elastic deformation.

Prior Art

In order to avoid these disadvantages it has already been proposed (German Offenlegungsschrift No. 24 44 464) to reinforce the swivel tube drive by suitable dimensioning of the feed shaft and of the rocking lever acting upon the end of the swivel tube, or to construct the swivel tube drive in such a way, that its parts not only act upon the end facing the feed cylinders, but also upon the end at the mounting, whereby elastic deformation of the swivel tube is opposed simultaneously. To avoid the formation of a slit at the cylinder end of the swivel tube, which could not be prevented despite the above measures, it is proposed further, to make the spacer, arranged at the rear wall of the hopper, adjustable with respect to the rear wall.

A reliable seal should be achieved according to a further proposal (German Offenlegungsschrift No. 26 32 816), in that the wear ring is mounted on an additional locating means movable and preferably swiveling with respect to the end of the swivel tube, and in this way to oppose non-uniform wear of the wear ring, which is caused in that the areas of the wear ring nearer to the swivel axis of the swivel tube are subjected to less wear than the areas further away, which sweep a larger surface of the rear wall of the hopper or its spacer during one swivel movement.

These apparatus, however, do require relatively expensive constructions, which have the disadvantage that the exchange of parts subjected to wear gives problems and that the objective is not attained satisfactorily, particularly at the very high pressures encountered in the swivel tube.

DISCLOSURE OF THE INVENTION

The invention, therefore, has the object to ensure a reliable seal of the swivel tube at its end facing the feed cylinder as well as at its mounted end using constructionally more simple means, to achieve uniform wear of the wear parts and to facilitate their interchangeability as well as to construct the swivel tube preferable in such a way that it can be mounted optionally, turned by 180° about a lateral axis.

This object is achieved according to the invention, in that the outer diameter of the face of the axially movable swivel tube at the side of the delivery pipe, which face is acted upon by the pressure of the material to be forwarded, is larger than the effective sealing diameter of the annular contact surface, by which the wear ring abuts indirectly or directly the wall of the hopper at the side of the cylinders—hereafter referred to as the "rear wall". The load on the face of the swivel tube at the side of the delivery pipe occurs preferably hydrostatically via a resilient element, which preferably provides a sealing function at the same time.

The swivel bearing at the side of the delivery pipe has, advantageously, an axial abutment, which is formed by the pressure flange of a connecting tube, which is attached to the hopper, preferably its rear wall, by means of adjustable bolts, for the adjustment of certain compression of the resilient element or for its readjustment.

By the construction of the swivel bearing according to the invention and the dimensions of the effective-seal diameter, the pressure of the material to be forwarded acting on the parts of the swivel bearing is changed into an axial thrust force acting on the face of the swivel tube and thus gives rise to an increased contact pressure of the wear ring against the rear wall of the hopper, or against a spacer consisting of wear-resistant material and pressed against the rear wall of the hopper, which spacer has two openings corresponding to the inside diameter of the feed cylinders.

Further advantages of the construction according to the invention arise from the subsidiary claims and the drawing, which shows schematically an embodiment, by way of example, of the subject of the invention and which is described below:

DESCRIPTION OF THE DRAWING

In the drawing are shown

Figure 1:
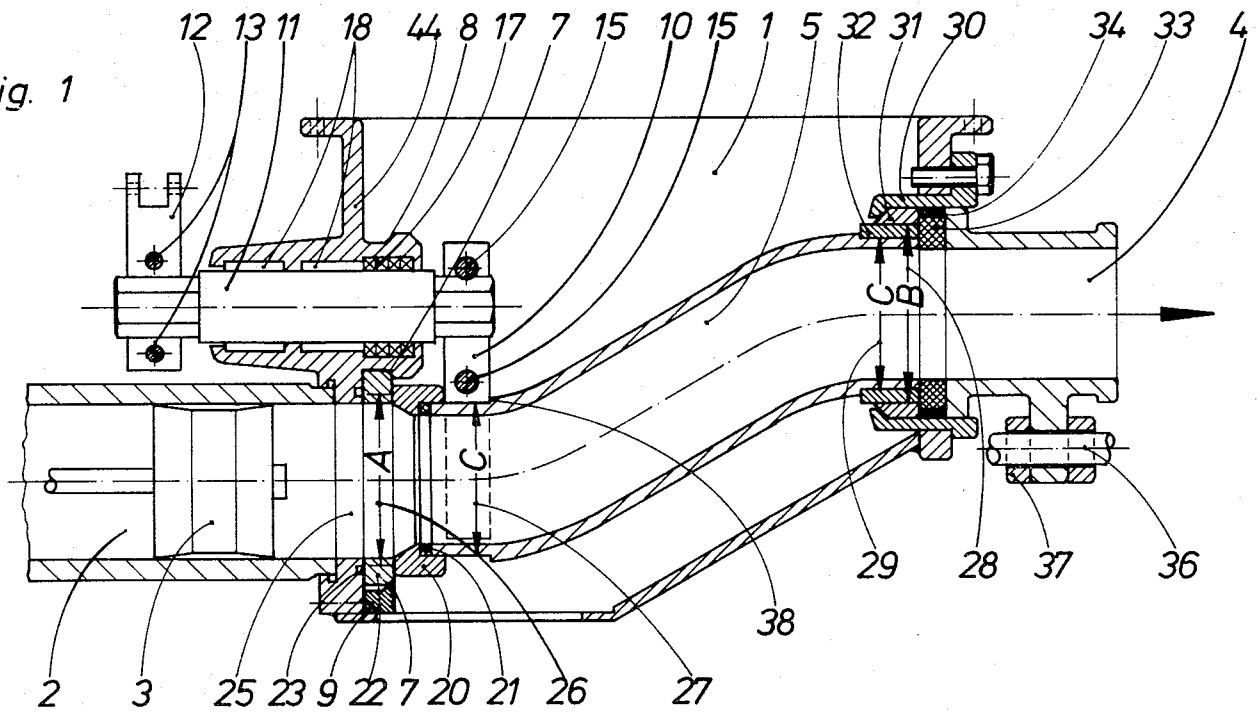
FIG. 1 a longitudinal cross section through the front end of one of the two feed cylinders, the swivel arrangement, the swivel tube and its bearing.
Figure 2:
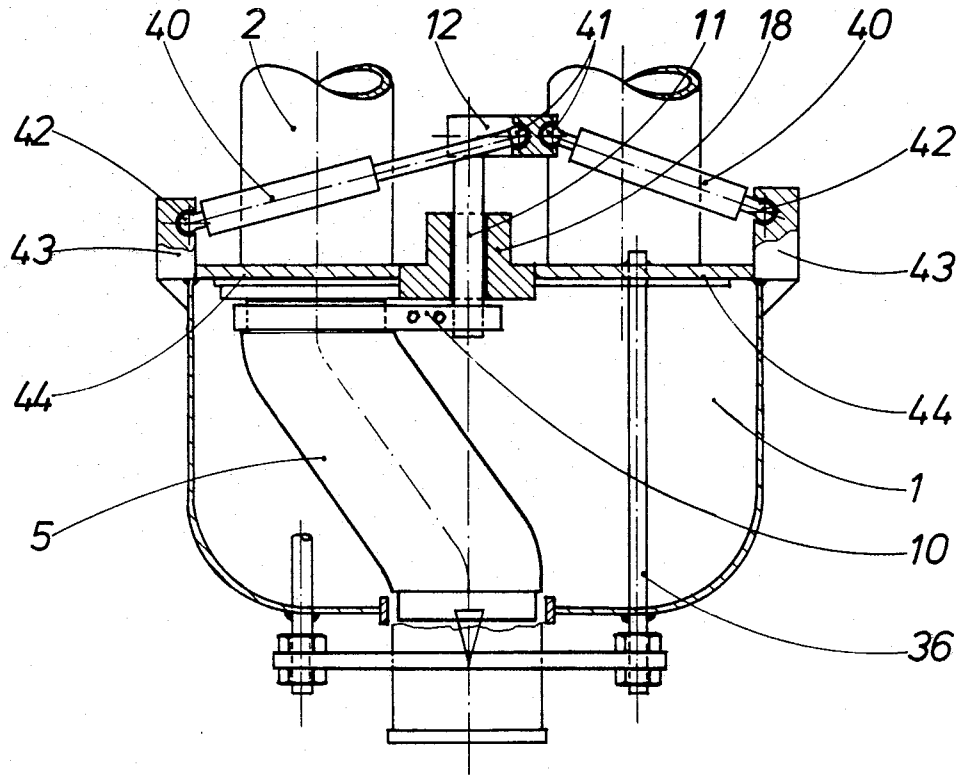
FIG. 2 a plan view of the part of the pump shown in FIG. 2, partly in section.
Figure 3:
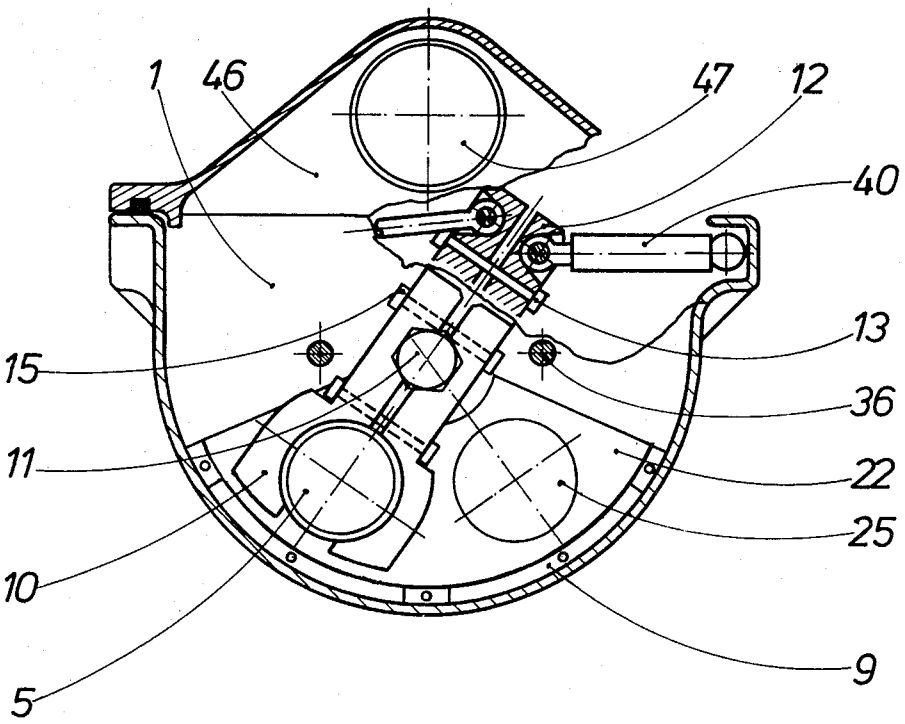
FIG. 3 a vertical action of the swivel tube and the swivel arrangement, in planes parallel to each other, through the hopper.

The swivel arrangement consists of the swivel lever 12, the swivel shaft 11 supported in the rear wall 44 of the hopper 1, and rocking lever 10 partly surrounding the end of swivel tube 5. The swivel lever 12 is actuated by means of two hydraulic cylinders 40, which are supported in swivel seats 42 formed by lugs 43 of the rear wall 44 and their piston rods engage ball joints of the swivel lever 12. Since the hydraulic cylinders 40, as shown in FIG. 2, form an acute angle with the rear wall 44, an axial thrust is exerted on the swivel shaft 11, which assists the axial contact pressure of the swivel tube 5, or the wear ring 20 arranged thereon, against the spacer 22—hereinafter called the "spectacle plate". To avoid possible stresses of the bearing of the swivel shaft which may be generated by elastic deformations of the hopper or its rear wall, the bearing 18 is so constructed that a slight gimbal movement of the swivel shaft 11 is possible. The swivel lever 12 and the rocking lever 10 are attached to the hexagonal ends of the swivel shaft 11 by means of clamp bolts 13, 15 respectively. The hydraulic cylinders 40 are preferably operated by the hydraulic pressure actuating the pistons 3 of the feed cylinders 2, so that with increasing pressure, the force components of the hydraulic cylinders 40, acting in the axial direction of the swivel shaft 11, exert an increasing, sealing contact force on the swivel tube 5. The bearing 18 is sealed by means of sealing rings 17.

To provide a pressure tight mounting of the spectacle plate 22, this plate has chamfers in the area adjacent the housing of the bearing 18 and at the edge adjacent the bottom of the hopper 1, which are overlapped by complementary chamfers, as provided at the circumference 8 of the bearing housing and at the connecting strips 9. The connecting strips 9 pulled against the rear wall 44 by means of bolts, press the spectacle plate 22 against the complementary chamfer at the circumference 8 of the bearing housing and thus against the rear wall 44, wherein a seal 23 has been fitted. This type of attachment of the spectacle plate 22, makes it possible to manufacture the plate of wear resistant, hard material, wherein it is difficult to drill holes, and to provide easy exchangeability.

The wear ring 20 is sealed with respect to the swivel tube 5 by a sealing ring 21 abutting an annular shoulder. This allows the wear ring a certain amount of free play, so that, even with misalignments or elastic deformations, the ring sealingly abuts the whole circumference of the circular openings provided in the spectacle plate 22, which correspond to the cylinder exits 25. The wear ring 20 presses against the rocker lever 10, which, in turn, abuts an annular shoulder 38 of the swivel tube, which prevents that with a too large axial contact pressure, the sealing ring 21 is squashed. In order to ensure a uniform contact of wear ring 20, even with a non-uniform wear of the surface of the spectacle plate 22, a spherical contact surface is provided between the rocker lever 10 or the swivel tube 5 and the wear ring 20.

At the bearing end of the swivel tube 5, a bearing bush 32 is inserted in a cylindrical recess, the outside diameter 28 (B) of which bush is larger than the effective sealing diameter 26 (A) of the face of the wear ring 20 abutting the spectacle plate 22 that is the median diameter of the contact surface of the wear ring 20 with the spectacle plate 22. This bearing bush 32 is supported in the bearing sleeve 31, the cone-shaped face of which is overlapped by the collar of a cup-shaped part 30, which is attached to the wall of the hopper 1 by means of bolts. Between the end faces of the swivel tube 5 and the bearing bush 32 on the one side and the flange of the connecting tube 4 on the other side, a resilient element 33 is provided which acts as a sealing ring, and which is surrounded by a pressure sleeve 34. The resilient element 33 is axially longer than the pressure sleeve 34. Tie rods 36 engage in lateral lugs of the connecting tube 4, the other ends of the rods are screwed into the rear wall 44. Self-locking nuts 37 are screwed onto these tie rods, which limit the compression of the bearing sleeve 31 and the sealing ring 33 and facilitate the assembly and disassembly by avoiding wrong adjustments. This construction of the swivel bearing, together with the clamp bolt 15, allow for easy removal of the swivel tube 5 in case of wear. After removal of the connecting tube 4 and dismantling of the cup 30, the swivel tube 5 can also be removed upwardly. Removal of the swivel tube 5, is however, also possible in the axial direction toward the pressure side, after removal of the connecting tube 4 and with the bearing sleeve 31 still in position.

The pressure exerted on the bearing sleeve 31 by the pressure sleeve 34 causes radial contact pressure and adjustment of bearing sleeve 31, so that bearing wear is compensated for or the penetration into the bearing of material to be forwarded is prevented.

The annular recesses at both ends of the swivel tube have the same dimensions, so that with the same size outside diameters 27 and 29 the swivel tube 5 can be assembled by turning it 180° about the lateral axis, in case of one-sided wear.

Uniform wear of the wear ring 20 at its face is ensured in that it can rotate about its axis on the end of the swivel tube, so that the working life of this wear ring is extended.

As a result of the automatic adjustment of the wear parts and the axial thrust exerted on the swivel tube 5, as well as of the uniform wear of the wear parts of all the surfaces exposed to wear, improved operating reliability is achieved as compared to known pumps.

I claim:

1. A piston pump particularly intended for the delivery of viscous substances such as concrete, comprising a hopper having a rear wall and an opposite front wall, two feed cylinders disposed in laterally spaced parallel relation and opening through said rear wall into said hopper, a delivery pipe in communication with said hopper through said front wall thereof, an S-shaped swivel tube located within said hopper and having an inlet end and an outlet end with said outlet end opening into said delivery pipe and said inlet end being swivelably movable alternately between said feed cylinders, a bearing bush surrounding the outlet end of said swivel tube and fixed thereto, a wear ring positioned in sealed contact with said inlet end of said swivel tube and arranged in sliding contact with said rear wall, the outside diameter of said bearing bush is larger than the effective sealing diameter of said wear ring at the inlet end of said swivel tube in contact with said rear wall, and a resilient element located between the outlet end of said swivel tube and said delivery pipe, a pressure sleeve laterally encircling said resilient element, and said resilient element is exposed to the conveying pressure acting in said swivel tube.

2. A piston pump, as set forth in claim 1, wherein axially adjustable tie rods are connected to said delivery pipe adjacent the outlet end of said swivel tube and extend therefrom to and are detachably connected to said rear wall.

3. A piston pump, as set forth in claim 1 or 2, wherein said delivery pipe has a pressure flange extending radially outwardly at the end thereof in contact with said resilient element.

4. A piston pump, as set forth in claims 1 or 2, wherein said rear wall includes a spectacle plate acting as a spacer between said rear wall and the inlet end of said swivel tube, said spectacle plate is formed of a wear-resistant material and has a pair of openings therethrough corresponding to the inside diameter of said feed cylinders, and said wear ring at one end abuts against said spectacle plate and at the other end overlaps and extends axially along the inlet end of said swivel tube.

5. A piston pump, as set forth in claim 4, wherein connecting strips detachably connect said spectacle plate to said rear wall with said connecting strips overlapping an edge of said spectacle plate and screws connecting said connecting strips of said rear wall.

6. A piston pump, as set forth in claim 5, wherein a sealing ring is arranged between said spectacle plate and said rear wall around each of the openings through said spectacle plate corresponding to the inside diameter of said feed cylinders and each said sealing ring is spaced radially outwardly from the opening through said spectacle plate.

7. A piston pump, as set forth in claim 20, wherein said wear ring has an annular shoulder thereon facing toward the outlet end of said swivel tube, and a sealing ring arranged between said annular shoulder on said wear ring and the inlet end of said swivel tube.

8. A piston pump, as set forth in claim 1 or 2, wherein said swivel tube has the same inside diameter over its full axial length, an axially extending cylindrically shaped recess at each of the opposite ends of said swivel tube, said bearing bush fitted into said cylindrical recess at the end of said swivel tube in bearing contact with said resilient element, and rocker lever jaws mounted in said cylindrical recess at the inlet end of said swivel tube.

9. A piston pump, as set forth in claim 8, wherein a bearing sleeve laterally encloses and is in surface contact with said bearing bush, and said pressure sleeve is located between said bearing sleeve and the adjacent end of said delivery pipe.

10. A piston pump, as set forth in claim 1, wherein said resilient element comprises a sealing ring having an axial length greater than the axial length of said pressure sleeve.

11. A piston pump, as set forth in claim 7, wherein said wear ring sealed to the inlet end of said swivel tube by said sealing ring is rotatably mounted on the inlet end of said swivel tube.

12. A piston pump, as set forth in claim 1, wherein a swivel shaft is mounted in and extends transversely of said rear wall, said swivel shaft having a first end located within said hopper and a second end located outwardly from said rear wall of said hopper, a rocking lever mounted on the first end of said swivel shaft, a swivel lever mounted on the second end of said shaft, a pair of hydraulic cylinders spaced angularly apart about said swivel shaft and connected to said swivel lever, said hydraulic cylinders disposed at an acute angle with said rear wall, and swivel seats formed in lugs positioned on said rear wall, and said hydraulic cylinders each extending between one of said swivel seats and said swivel lever.

* * * * *